US005745081A

United States Patent [19]

Brown et al.

[11] Patent Number: 5,745,081

[45] Date of Patent: Apr. 28, 1998

[54] HF ANTENNA FOR A HELICOPTER

[75] Inventors: Luther E. Brown, Stuart, Fla.; Graham Luck, Southampton, United Kingdom; Terence Keith Gibbs, Stubbington, United Kingdom

[73] Assignee: Lockheed Martin Corporation, Bethesda, Md.

[21] Appl. No.: 405,729

[22] Filed: Mar. 17, 1995

Related U.S. Application Data

[63] Continuation of Ser. No. 101,510, Aug. 2, 1993, abandoned.

[30] Foreign Application Priority Data

Aug. 5, 1992 [GB] United Kingdom ..... 9216585
Nov. 11, 1992 [GB] United Kingdom ..... 9223580

[51] Int. Cl.[6] ..... H01Q 1/28

[52] U.S. Cl. ..... 343/705; 343/708

[58] Field of Search ..... 343/705, 708; 336/122, 123; H01G 1/28

[56] References Cited

U.S. PATENT DOCUMENTS

| | | | |
|---|---|---|---|
| 756,083 | 1/1904 | Gussel . | |
| 1,081,708 | 8/1913 | Bell Aerospace Corp. . | |
| 2,490,330 | 12/1949 | Wilde, Jr. | 343/708 |
| 2,624,981 | 6/1953 | Christophe . | |
| 2,835,932 | 2/1958 | Poinsard . | |
| 2,881,408 | 4/1959 | Dudley | 343/763 X |
| 3,144,646 | 8/1964 | Breithaupt | 343/708 X |
| 3,268,880 | 8/1966 | Miller | 336/123 X |
| 3,389,393 | 6/1968 | Young, Jr. | 343/708 |
| 3,478,353 | 11/1969 | Adams, Jr. | 343/708 |
| 3,519,969 | 7/1970 | Hoffman | 336/123 X |
| 3,550,130 | 12/1970 | Shaw | 343/705 |
| 3,611,376 | 10/1971 | Gutleber | 343/11 |
| 3,737,899 | 6/1973 | Georgopoulos | 343/853 |
| 3,758,845 | 9/1973 | MacKelvie et al. | 336/123 X |
| 3,896,446 | 7/1975 | Kondoh et al. | 343/705 |
| 4,253,101 | 2/1981 | Parr | 343/763 |
| 4,258,365 | 3/1981 | Hockham et al. | 343/763 |
| 4,281,328 | 7/1981 | Shores | 343/763 |
| 4,358,746 | 11/1982 | Miller et al. | 343/763 X |
| 4,516,097 | 5/1985 | Munson et al. | 343/763 X |
| 4,814,779 | 3/1989 | Levine | 343/754 |
| 4,908,630 | 3/1990 | Clerc | 343/763 |
| 4,928,108 | 5/1990 | Kropielnicki et al. | 343/704 |
| 5,225,844 | 7/1993 | Williams | 343/705 |

FOREIGN PATENT DOCUMENTS

| | | | |
|---|---|---|---|
| 0002706 | 1/1981 | Japan | 343/763 |
| 0025704 | 2/1982 | Japan | 343/763 |

OTHER PUBLICATIONS

Hall et al, *The ARRL Antenna Book*, 1983, pp. 1–6–1–9.

*Primary Examiner*—Hoanganh T. Le
*Assistant Examiner*—Tan Ho
*Attorney, Agent, or Firm*—John J. Timar; William H. Steinberg; Marshall M. Curtis

[57] ABSTRACT

Disclosed is a combined antenna and helicopter rotor blade. The antenna has one or more electrically non-conductive rotor blades, each having an electrical conductor positioned parallel to the major axis of a respective rotor blade. An electrical connection is provided to connect the antenna to a radio for the reception or transmission of radio waves. Also disclosed is a communications system including apparatus for the transmission or reception of radio waves. Two of the electrical conductors, having angular positions nearer to a predetermined angular position are connected via the electrical connector to the radio. The remaining conductors may either be connected to the body of the helicopter or supplied with a signal out of phase compared to that supplied to the two electrical conductors.

17 Claims, 8 Drawing Sheets

HF ANTENNA FOR A HELICOPTER

This is a continuation of Ser. No. 08/101,510 filed on Aug. 2, 1993, now abandoned.

FIELD OF THE INVENTION

The invention relates to transmission and reception of radio waves in the HF spectrum and more specifically to use of rotor blades on a helicopter (or rotary winged aircraft) as an efficient directional antenna.

BACKGROUND OF THE INVENTION

Conventionally antennas for helicopters have been mounted close to the body of the helicopter. Typically an antenna has consisted of a rigid member parallel to and spaced from the helicopter body by spacers. An alternative that has been used consists of a wire stretched between two spacers used to space the antenna away from the helicopter body. Insulators join the wire onto the spacers. The spacers are usually relatively short which result in the antenna being placed close to the body of the helicopter. Both of these alternative antennas can be made directional, but result in a shorter effective length of antenna. In addition any directionality is fixed relative to the orientation of the helicopter.

U.S. Pat. No. 4,042,929 shows a navigation system in which antennas are used at the tips of each of the blades of a helicopter rotor. The received signals are processed on the rotor blade and introduced into the body of the helicopter by means of slip rings and contact brushes. The antennas consist of a series of dipoles flattened along the centerline of each blade, positioned proximate to the tips of the blades.

A popular band of frequencies for operation of military and commercial communications is the HF band of frequencies. This band extends between 2 MHz and 30 MHz and has a number of technical and tactical advantages over the higher frequencies that are available. In a typical modern installation, military VHF (30–170 MHz) and UHF (225–400 MHz) are used alongside the HF band for communication between the helicopter and ships or other helicopters and aircraft.

Some advantages of the use of HF band frequencies are that HF band frequencies are the highest frequencies that will reflect from the ionosphere to provide long range skip communication, higher frequencies offer only line of site communication and cannot go over the horizon and propagation attenuation increases with frequency by a factor of 20 log frequency. The natural phenomena of range, antenna efficiency and atmospheric noise are all functions of frequency and the best compromise of the factors is achieved between 2 and 30 MHz. More efficient power amplifiers are available at the HF band of frequencies.

One factor that limits the HF band performance on aircraft and helicopters is the length of the antenna. For maximum efficiency, the antenna should be equal in length to the wavelength. The wavelength in meters can be calculated as the velocity of propagation of the radio waves in meters per second divided by the frequency in Hertz. The velocity of propagation of radio waves is constant and is approximately equal to $3\times10^8$ meters/second.

For UHF communications (typically 300 MHz), the wavelength calculated from the above equation is 1.0 meters. This is a practical length for an antenna, such as those types described earlier, to be mounted on a helicopter, despite intense competition for space from electronic equipment and in military helicopters also from heavy armament.

In the HF band, at a frequency of 3 MHz, the wavelength calculation shows that an antenna of length 100 meters is required. This is an impractical length for a helicopter. This can be overcome by using a sub-multiple of the ideal length obtained from the wavelength calculation. However the antenna efficiency falls as the length of the antenna is reduced.

Another factor that limits the HF band performance on aircraft and helicopters is the difficulty of providing a directional antenna. A directional antenna has an increased gain in a direction or directions relative to the antenna. It also has a decreased gain in other directions relative to the antenna. The lack of directionality of an antenna results in a loss of communication range compared with an antenna having directionality and can also result in the signal being received by other than the receiver for which it was intended. In order to provide optimal communication between the directional antenna and another antenna, the directional antenna needs to be oriented so that a direction of increased gain is oriented toward the desired receiving antenna.

This orientation can be achieved by physical rotation of a directional antenna to point towards the other antenna, however this further limits its length and hence efficiency, thus offsetting any benefit from the increased gain due to directionality.

Conventional helicopters have rotor blades made primarily of metal. These rotor blades are fixed to the gearbox and engines via a substantial conductive path of metallic parts making the blades difficult to employ as an antenna.

The new generation of helicopters are moving away from metallic rotor blades to using composite constructions. An example is the Aerospatiale Ecureuil which has a Starflex rotor blade that is made mainly of glass fiber. Other helicopters have blades made of carbon and glass fibers with internal foams.

DISCLOSURE OF THE INVENTION

Accordingly the invention provides a directional antenna for use with apparatus for transmission or reception of radio waves in a rotary winged aircraft having a body provided with rotor blades, the antenna comprising three or more electrically non-conductive rotor blades, capable of being rotated with respect to the body of the rotary winged aircraft around an axis perpendicular to the blades; two first electrical conductors, each conductor being positioned parallel to the major (i.e., longitudinal) axis of a respective rotor blade and being in contact therewith; one or more second electrical conductors, each conductor being positioned parallel to the major (i.e., longitudinal) axis of a respective rotor blade, the second electrical conductors not being electrically connected to the first electrical conductors; means for providing a connection from the plurality of first electrical conductors to the apparatus for transmission or reception of radio waves; means for dynamically selecting the first electrical conductors from all of the electrical conductors as those having an angular position nearer to a first predetermined angular position relative to the body of the rotary winged aircraft than others of the conductors, and for dynamically selecting the others of the conductors as second electrical conductors.

In a first embodiment the second electrical conductors are electrically connected to the body of the rotary winged aircraft.

In a second embodiment one or more of the second electrical conductors are provided with a signal that is out of phase with the signal provided to the first electrical conductors. Preferably one or more of the second electrical conductors not provided with an out of phase signal are electrically connected to the body of the rotary winged aircraft.

Preferably the connection means comprises slip rings and contact brushes. The slip rings and contact brushes are preferably also the means for dynamically selecting conductors as first conductors or as second conductors. In another embodiment the selecting means comprises electrical diodes and means for controlling the direct current biasing of the electrical diodes.

Preferably the directional antenna further comprises a control means for maintaining said first predetermined angular position with respect to a known geographic point. The control means preferably comprises a stepping motor. Preferably the directional antenna further comprises means for maintaining the first predetermined angular position constant with respect to a remote apparatus for transmitting or receiving radio waves.

In a preferred embodiment of the directional antenna the length of each electrical conductor is substantially similar to that of the rotor blade and the radio waves transmitted or received have wavelengths in the range from 10 meters to 150 meters.

Also provided is a communications system for transmission and reception of radio waves in a rotary winged aircraft having a body provided with rotor blades, the system comprising apparatus for transmission or reception of radio waves; three or more electrically non-conductive rotor blades, capable of being rotated with respect to the body of the rotary winged aircraft around an axis perpendicular to the blades; two first electrical conductors, each conductor being positioned parallel to the major axis of a respective rotor blade and being in contact therewith; one or more second electrical conductors, each conductor being positioned parallel to the major axis of a respective rotor blade, the second electrical conductors not being electrically connected to the first electrical conductors; means for providing a connection from the plurality of first electrical conductors to the apparatus for transmission or reception of radio waves; and means for dynamically selecting the first electrical conductors from all of the electrical conductors as those having an angular position nearer to a first predetermined angular position relative to the body of the rotary winged aircraft than others of the conductors, and for dynamically selecting the others of the conductors as second electrical conductors.

BRIEF DESCRIPTION OF THE DRAWINGS

Embodiments of the invention will now be described, by way of example, with reference to the accompanying drawings, in which.

DETAILED DESCRIPTION OF THE INVENTION

Figure 1:
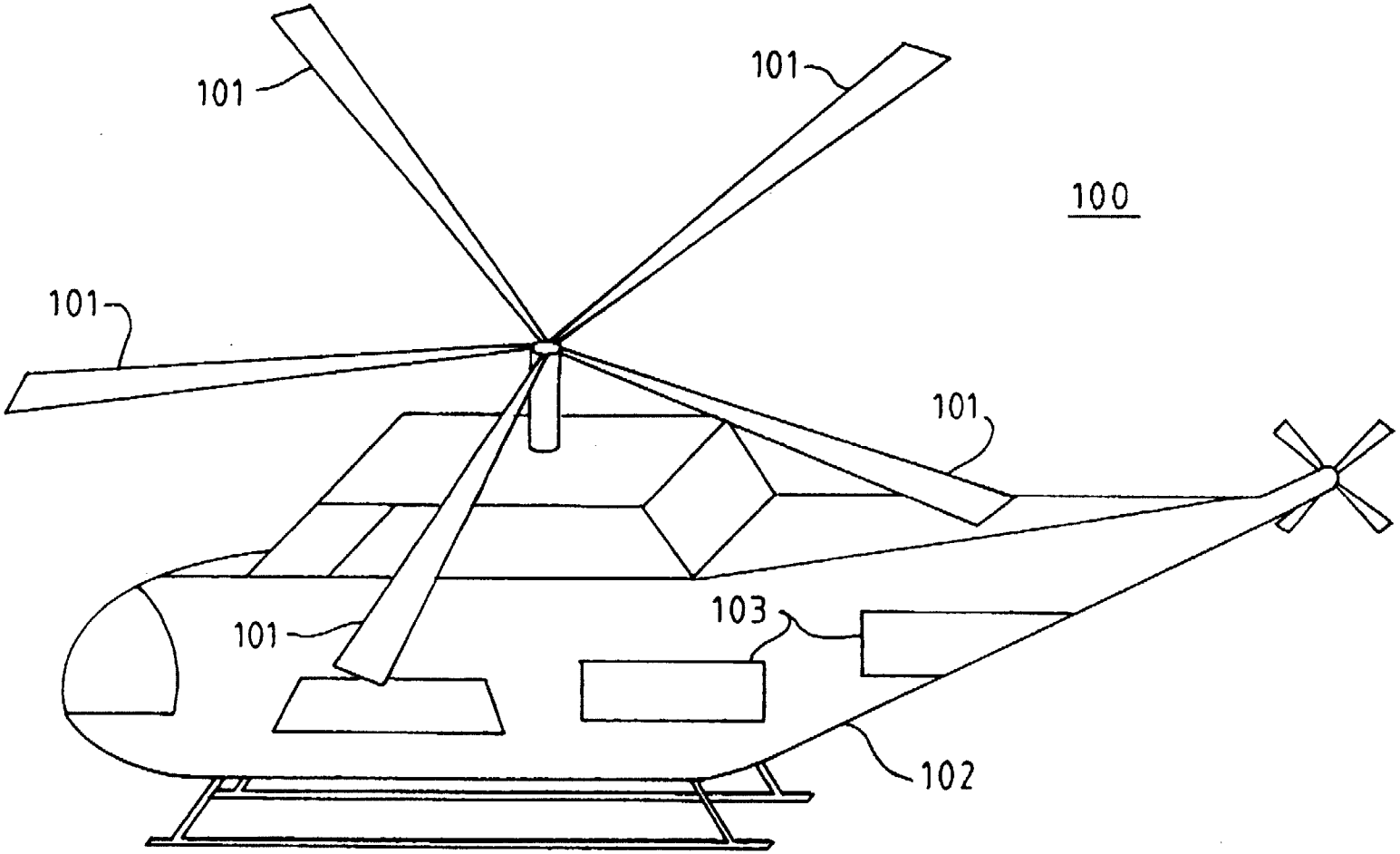
FIG. 1 is schematic view of a helicopter showing the rotor blades positioned above the helicopter.

FIG. 1 shows a helicopter 100 with rotor blades 101 positioned above the fuselage 102 of the helicopter 100. The helicopter 100 is approximately 15 meters long and carries various equipment 103 fixed to the exterior of the fuselage 102. The fuselage 102 of the helicopter 100 is a ground plane for the frequencies used for radio reception and transmission. Because of the difficulty of finding an area of the fuselage 102 that is not a ground plane and does not already have other equipment 103 attached to it, HF antennas are usually short antennas with resultant low efficiency. This gives a reduction in system performance that is difficult to overcome without increasing the transmitter power. In addition, because of the difficulty of providing a rotatable antenna, HF antennas are usually omni-directional.

The efficiency of an antenna can be shown to approximate as follows in an isotropic radiator;

$$\text{Efficiency} = \frac{2.5}{2.5 + \dfrac{1.5}{\dfrac{(2 * PI * h)^3}{\text{Wavelength}}}}$$

where h=the length of the antenna in meters wavelength=the wavelength of the transmitted or received signal in meters PI=the constant 3.1415926 approx.

From the above equation, it can be seen that at 3 MHz a 100 meter long antenna could have an efficiency of 1, while a 2 meter long antenna, working at the same frequency, could have an efficiency of only 0.0033. This degradation of efficiency due to the reduced length exists when the antenna is used both in the transmit mode and in the receive mode. The receive antenna gain is dependent on the efficiency and the directionality of the antenna as well as other factors.

The relationship between antenna gain and the overall system performance can be represented by the following equation:

$$Pr = Pt + Gt + Gr - 20 \log f - 20 \log R - 32.4 - La$$

where

Pr=Received power (dBm)

Pt=Peak transmitter power (dBm)

Gt=Transmit antenna gain (dB)

Gr=Receive antenna gain (dB)

f=Frequency (MHz)

R=Range (Nautical miles)

La=Additional losses (dB)

The factor of 32.4 is a constant which reflects the units used for frequency and range.

The frequency and required range are fixed for any given scenario. Additional losses are all minimized in any good design. If a full wavelength omni-directional antenna is used from, for example, a ship then a gain of 1 might be possible. Conventional helicopters are forced to use inefficient omni-directional antennas, as measured by the equation for the antenna efficiency given above, so that the only option to achieve the required performance is to increase the transmitter power.

If the communication link is from helicopter to helicopter, then from the same equation we can see that the link performance will suffer both at the transmission and reception antennas.

Figure 2:
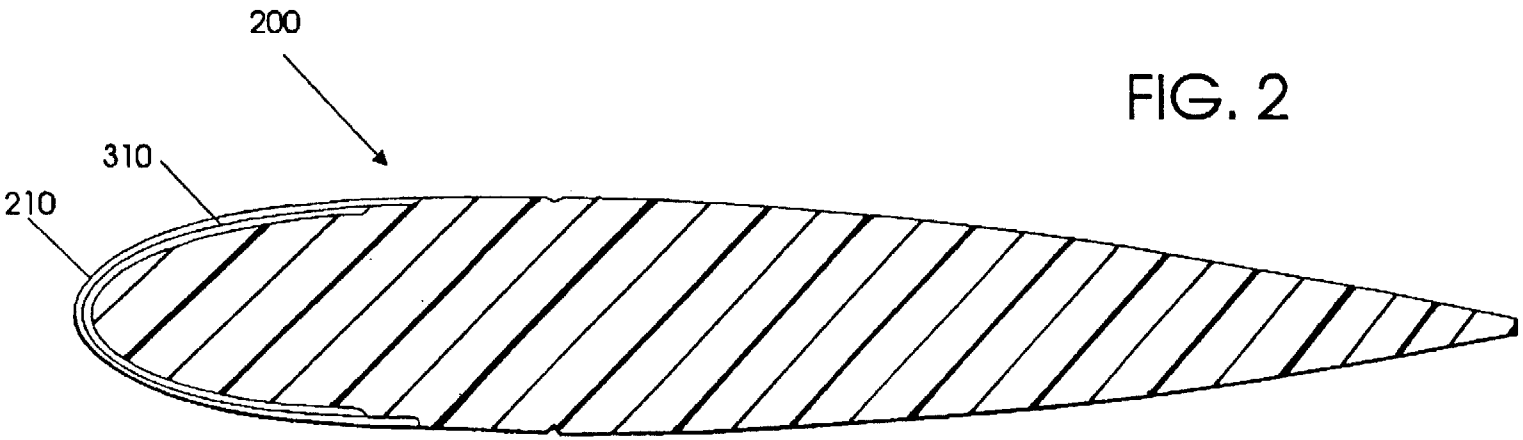
FIG. 2 is a section of one of the blades shown in FIG. 1 incorporating a first embodiment of the invention.

Use of a rotor blade 200 or rotor blades of the helicopter, such as is shown in FIG. 2, as an antenna allows the antenna to be considerably longer and hence more efficient. With the exception of a radiating element included in the blade and described later, the structure of the rotor blade 200 must be substantially electrically non-conducting. The use of the rotor blades as an antenna improves the system performance, particularly for helicopter to helicopter communication, where the antenna efficiency has an effect both on the transmit antenna gain and the receive antenna gain.

FIG. 2 shows a first embodiment of the invention where the rotor blade 200 has an erosion shield 210 fitted to the leading edge. The erosion shield 210 is intended to protect the leading edge of the rotor blade 200 from damage by particles in the air such as dust particles. It also provides some protection from such things as striking foliage, during hovering or landing, when close to the ground. The erosion shield 210 will typically be fabricated from a metal such as titanium.

The erosion shield 210 extends for the length of the rotor blade and so provides an antenna which is substantially equal to the length of the rotor blade. By making continuous simultaneous connection to more than one rotor blade, an effective antenna length of about twice the length of the rotor blade can be obtained. At 3 MHz this will provide an efficiency of around 0.7 (depending on the length of the rotor blades), compared with 1 for the ideal antenna length of 100 meters and 0.0033 for a 2 meter antenna. In the first embodiment all of the rotor blades of the helicopter are used.

Electrical connections are made from the erosion shields 210 to the apparatus in the fuselage 102 of the helicopter 100 by one of three methods which are described later with reference to FIGS. 4 to 6. Typically, when the present invention is not implemented, bonding jumpers are used to ground the erosion shields 210 to provide protection against lightning strikes and electromagnetic pulse. This protection can be retained, if required, by using spark gaps of a suitable breakdown voltage as is well known to those skilled in the art. Similarly, methods known to those skilled in the art to prevent static build up caused by the motion of the rotor blades can be used (in the form of discharge wicks, for example).

Figure 3:
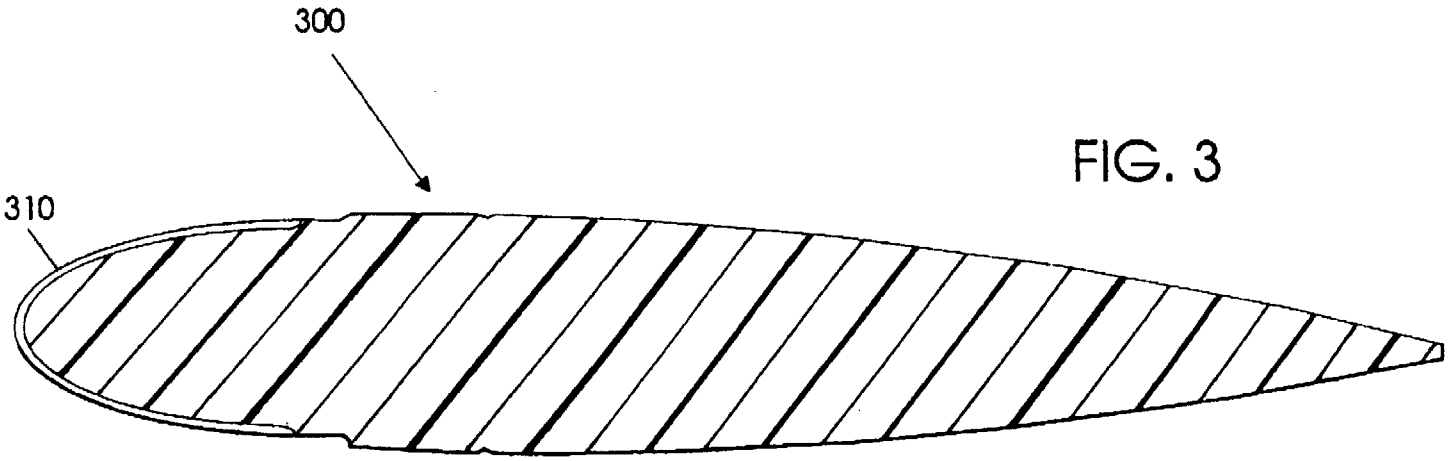
FIG. 3 is a section of one of the blades shown in FIG. 1 incorporating a second embodiment of the invention.

FIG. 3 shows a second embodiment of the invention which uses a heater filament 310 that is already present in the rotor blade 300 as an antenna.

At the front edge of the rotor blade 300 is a heater filament 310 which is used for deicing the leading edge of the rotor blade. The transmitted and received signals are provided to the radio apparatus in the fuselage 102 of the helicopter 100 by use of the same means used for the transfer of power to the heater filament 310. This will be described later with reference to FIGS. 4 to 6. This embodiment will also require a means to combine the transmitter signal with the power for the heater filament 310 and also for separating the receiver signal from the power. The means for achieving this are well known to those skilled in the art, and are widely applied to such areas as the dual use of windscreen elements in automobiles as both demisting elements and receiving aerials.

As with the erosion shield 210 used in the first embodiment, the length of the antenna will be substantially similar to the length of the rotor blade 300, or twice this value if multiple rotor blades are used.

The overall system performance is improved for a negligible increase in system cost.

If the transmitter power is kept constant, then a greater signal power is radiated, giving the transmitted signal greater immunity against radio jamming.

The antenna is positioned above the helicopter fuselage so that the radiation from the antenna becomes omni-directional with no shading of the antenna due to the fuselage itself.

When the helicopter is hovering at low altitudes the antenna is placed higher relative to the ground giving improved communications over an antenna placed on the fuselage of the helicopter.

The losses shown in the equation for system performance as additional losses include capacitive losses from the antenna to the airframe. These losses are reduced because of the greater distance from the fuselage to the antenna.

When compared with a conventional antenna of the type described earlier which consists of a wire antenna with insulators spaced from the helicopter, the antenna of the present invention is much more mechanically robust and less liable to damage in the ground handling process. For a helicopter that has a folding tail for storage in restricted spaces the antenna of the present invention is less liable to damage during this process also.

The safety of personnel is improved because the transmitting antenna is placed further away from the occupants, with the resultant decreased exposure to electromagnetic fields. The possibility of reducing the transmitter power also reduces exposure to electromagnetic fields.

Figure 4:
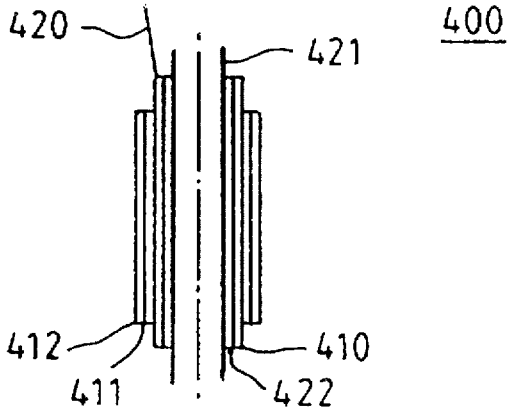
FIG. 4 is a cross-sectional diagram of a means for providing an electrical connection between blades, such as those of FIG. 2, and apparatus within the helicopter of FIG. 1.

FIG. 4 shows connection means 400 for making a connection from the radio apparatus in the fuselage 102 of the helicopter 100 to the antenna. This first embodiment uses capacitive coupling between a rotating plate, which can be in the form of a first cylinder 410, attached to the antenna (such as erosion shield 210 or heater filament 310) on one or more rotor blades and another fixed plate, which can also be in the form of a second cylinder 412, concentric with the first cylinder. An air space 411, which acts as a dielectric, exists between the two cylinders. An insulator 422 is used to insulate the rotor blade shaft 421 from the capacitor formed by the two cylinders (410, 412).

Figure 5:
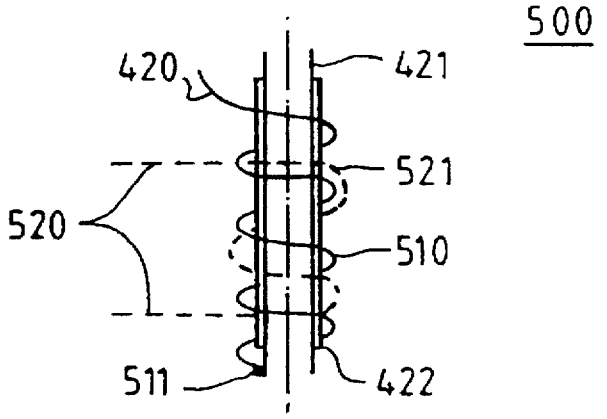
FIG. 5 is a cross-sectional diagram of another means for providing an electrical connection.

FIG. 5 shows a connection means 500 for making a connection to the antenna using inductive coupling. In this second embodiment one rotating winding 510 of an air spaced transformer is connected to the rotor blades via cable 420 and the rotor shaft via connection 511. Another fixed winding 521 of the air spaced transformer is connected to the radio apparatus in the fuselage 102 of the helicopter 100 via cable 520.

Figure 6:
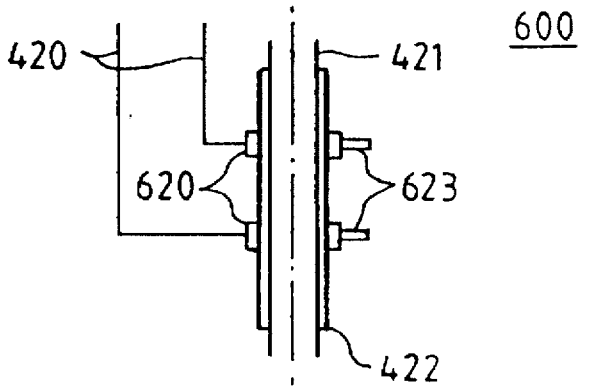
FIG. 6 is a cross-sectional diagram of yet another means for providing an electrical connection.

FIG. 6 shows a connection means 600 for making a connection to the radiating element. In this third embodiment the radiating element may be an erosion shield 210, a deicing element 310, an embedded wire or a conductive coating. A cable 420 is connected to the element and follows a path to the rotor blade shaft 421. Here contact is made to the apparatus in the fuselage 102 of the helicopter 100 by means of slip rings 620 and contact brushes 623. The cable 420 is connected to a conducting slip ring 620 rotating with a shaft 421 carrying the helicopter rotor blade 101. Brushes 623 cooperate with slip rings 620 and are tied to a stationary conductor.

Whether the heater filament 310 or the erosion shield 210 (or even a conventional HF antenna) are used as an antenna and whatever means of connection to the antenna is used, it is necessary to include in the system an antenna tuning unit to allow the impedance of the antenna to be matched to the impedance of the transmitter and receiver over a wide range of frequencies. The design and construction of antenna tuning units is well known to those skilled in the art and will not be discussed further.

A third embodiment of the antenna involves a wire embedded into the blade. This wire is preferably placed within a cavity in the rotor blade or is made by including a layer of metallic foil on the surface of the trailing edge of the blade 200. Connection to the antenna is achieved by any one of the three methods described above, that is by slip rings 620 and brushes 623 or by capacitive or inductive coupling.

A fourth embodiment of the antenna utilizes a nickel spray that is used to provide protection against corrosion on composite blades. A connection is made to the conductive coating as described above for the wire embedded in the blade 200.

Figure 7:
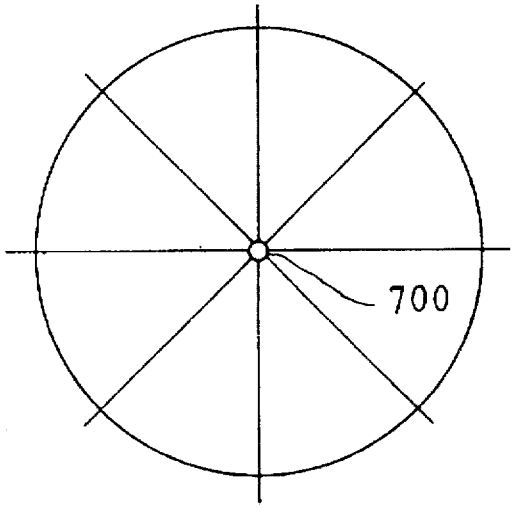
FIG. 7 is a polar diagram of radiation from or to an omni-directional antenna such as one formed from the elements of FIG. 2.

Directional antennas are used to concentrate the radiated field strength either from a transmitting antenna, or to a receiving antenna. FIG. 7 shows the polar diagram 710 of radiation from or to an omni-directional antenna 700. The radial position represents the relative field strength transmitted or received in that angular direction. The polar plot of an omni-directional antenna using conductors affixed to all of the rotor blades of a helicopter is of this form.

Figure 8:
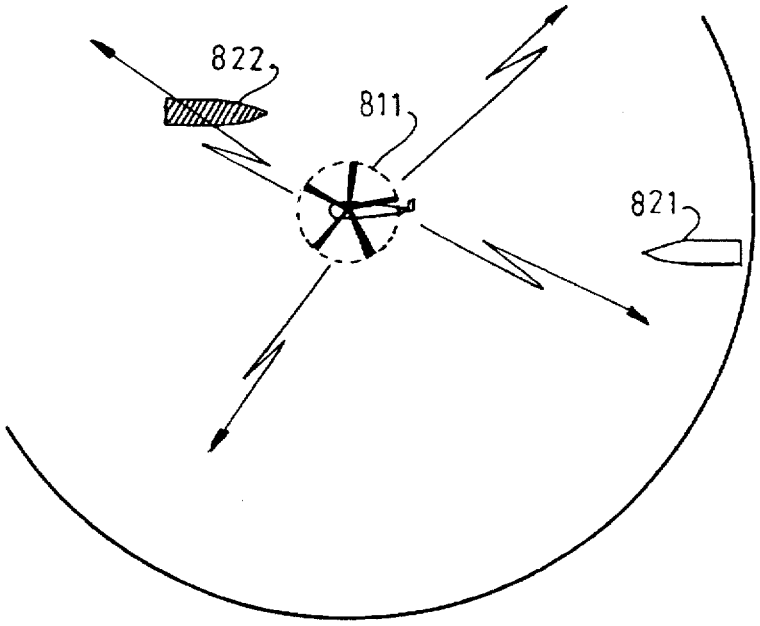
FIG. 8 PRIOR ART
FIG. 8 is a view of a prior art system using omni-directional antennas such as that of FIG. 2.

FIG. 8 shows a possible situation using omni-directional transmissions. Helicopter 811 transmits using an omni-directional aerial so that the signal strength received by ships 821 and 822 is dependent only on their radial distance from helicopter 811 and not on their angular position. The vessel 821 with which it is desired to communicate actually receives a lower signal strength than vessel 822. Electromagnetic radiation emissions from the transmitting helicopter can be monitored in such a situation. Signals are often encoded by an encryption device, however the fact that radio signals are detected at all may be useful information.

Figure 9:
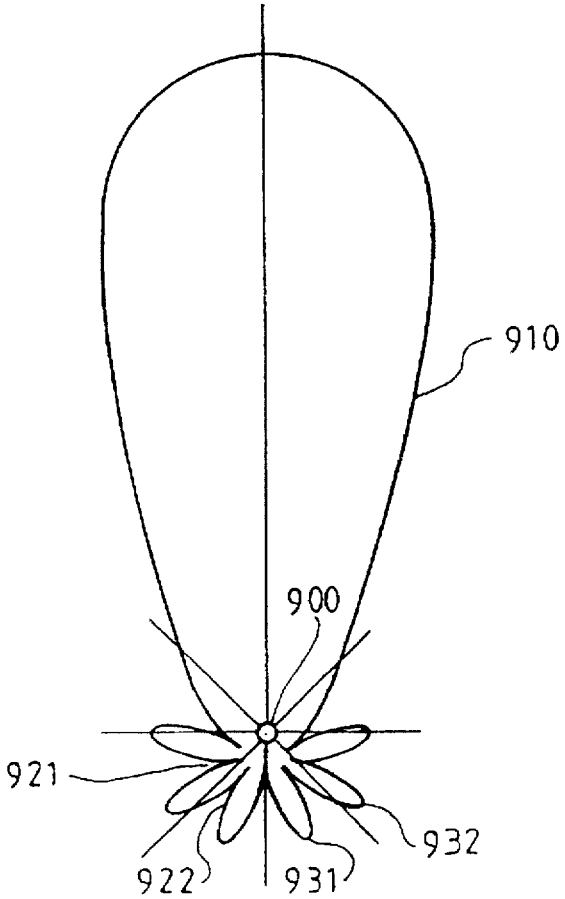
FIG. 9 is a polar diagram of radiation from or to a directional antenna such as is used in the present invention.

FIG. 9 shows the polar plot of a typical directional antenna 900, in this case a Yagi type antenna. Angular portions enclosed by secondary lobes 931, 932 have a higher gain than adjacent areas 921, 922 but this gain is much lower than the gain in angular positions enclosed by the main lobe 910 or the gain from an omni-directional antenna 700 having a polar diagram 710 such as that of FIG. 7. The gain of the antenna 900 is increased within the angular positions enclosed by the main lobe 910 at the expense of radiation in the unwanted areas 921, 922. The increased gain can be shown to equate as follows;

$$\text{Gain (ratio)}=(4*PI*Ae)/(Wl*Wl)$$

Where Ae=effective area of the lobes, and

Wl=wavelength of the transmitted or received signal.

Increased range is achieved in the desired direction (within the angular positions enclosed by lobe 910) during both transmission and reception. Also, as described below with reference to FIGS. 12 and 10, increased security is achieved against a signal being received by other than the receiver for which it was intended.

Figure 10:
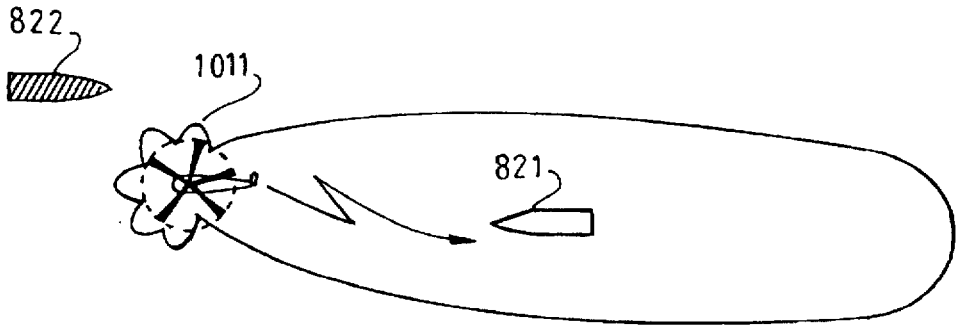
FIG. 10 is a view of a communications system using at least one directional antenna such as that of the present invention.

FIG. 10 shows the same situation as FIG. 8 but helicopter 1011 has a directional antenna having a polar diagram such as that of FIG. 9. The directional antenna may be used to communicate with, for example, a ship, while minimizing the risk of detection.

A coupling method is necessary to link the rotating antenna to the radio equipment. A slip ring and brushes may be employed for this purpose. If a slip ring in the form of a commutator is used, then only during a portion of the arc described by the rotating antenna as it rotates, is the antenna selectively connected to the apparatus for receiving and transmitting radio signals. Electromagnetic radiation from the antenna is only received from or transmitted to another antenna located in that portion when the antenna is connected to the apparatus for receiving and transmitting radio waves.

Figure 11:
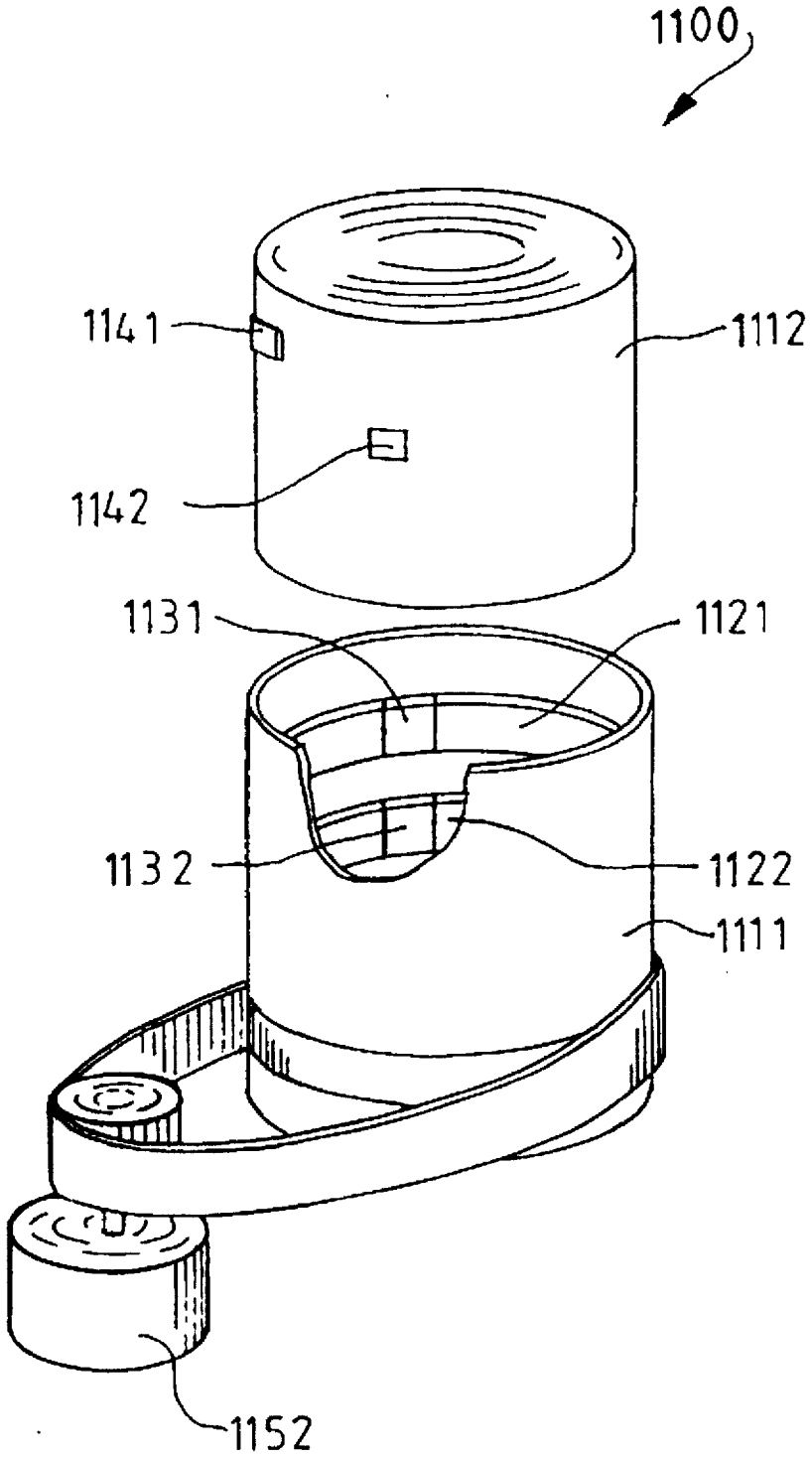
FIG. 11 is a perspective view of a commutator used in the present invention.

FIG. 11 is a perspective view of a commutator 1100, where some of the elements of a rotating antenna/blade assembly are used for transmission while other elements of the antenna/blade assembly are grounded to the aircraft structure, or fed with a phase shifted signal during selected segments of its sweep, in order to produce a controllable directional antenna.

The commutator 1100 consists of a shell 1111, which does not rotate with the rotor blades, and a part of the rotor blade shaft 1112 which rotates with the rotor blades. The shell 1111 contains a number of slip rings, such as 1121 and 1122, preferably one slip ring per rotor blade. The slip rings are connected to the apparatus for transmitting and receiving radio signals or to the helicopter body as described later. The rotor shaft has brushes, such as 1141 and 1142, which are connected to one or more of the electrical conductors on the rotor blade. The brushes 1141, 1142 provide a connection to a corresponding slip ring 1121, 1122.

Each slip ring is divided into angular portions, each portion being connected to either the helicopter body or to a zero phase shift signal or to a phase shifted signal. In this way the signal provided to any one electrical conductor on the rotor blades can be made dependent on the conductors physical position relative to the helicopter body. Normally there will be a gap 1131, 1132 between breaking of a connection from the electrical conductor to the making of another connection to the electrical conductor.

The use of a commutator assumes and takes advantage of the capability of achieving directionality in the antenna pattern. It also further offers the advantage of using the commutation in various configurations to control the direction of the directed energy lobe 910. By proper selection of the connections to the electrical conductors, the main beam of the antenna can be made more directional and its direction of maximum radiation can be controlled relative to the aircraft longitudinal axis.

The directionality is achieved by feeding two or more blades with the transmitter power and utilizing one or more of the remaining blades either with phase shifted energy or by grounding them to reduce the radiated field intensity of the back lobe.

Grounded Configuration

Figure 12:
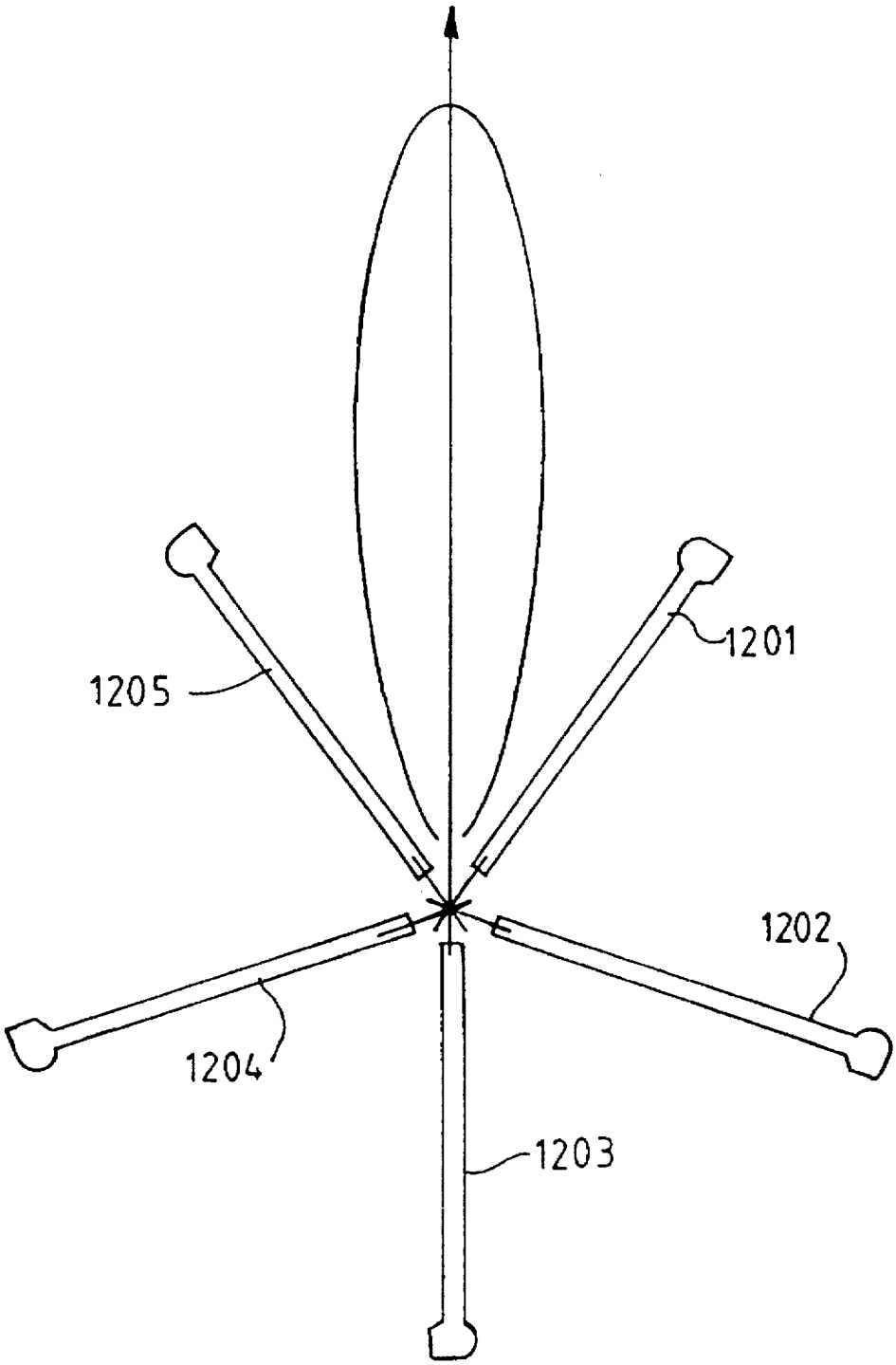
FIG. 12 is a diagram used to illustrate the connection via the commutator of FIG. 11 of the electrical conductors in the invention.

In a first embodiment, if the antenna is grounded as it rotates in the portion of the arc located at 180 degrees from the active portion, then the directivity is further enhanced. FIG. 12 shows a typical composite rotor having five rotor blades. This gives an angle between the rotor blades of 72 degrees. If a commutator is arranged to connect the apparatus to the antenna conductor of two rotor blades 1201, 1205 at any one time, as they rotate, then this will form a 'V' configuration antenna that has directional properties without any contribution to directionality from the remaining three rotor blades. The antenna conductors of rotor blades 1202, 1204 are preferably grounded to act as a reflector and further add to the directivity of the antenna. Blade 1203 may either be grounded or may be open circuit. As the rotor blade assembly rotates in an anti-clockwise direction the rotor blade which was connected as blade 1202 rotates to the position of rotor blade 1201. In a preferred embodiment there is a gap in the commutator where the blade is open circuit between the times when it is connected to the apparatus and when it is grounded.

A vertically staggered system is used for the commutator, as shown in FIG. 11. This technique ensures that the antenna conductors of two blades are always connected to the apparatus and optimum coupling is achieved.

The electrical coupling can also be achieved by inductive coupling or capacitor coupling using multiple coils or capacitors, one for each blade. The individual coils or capacitors can be selected at the appropriate time by means of a reversed biased diode control, for example.

Figure 13:
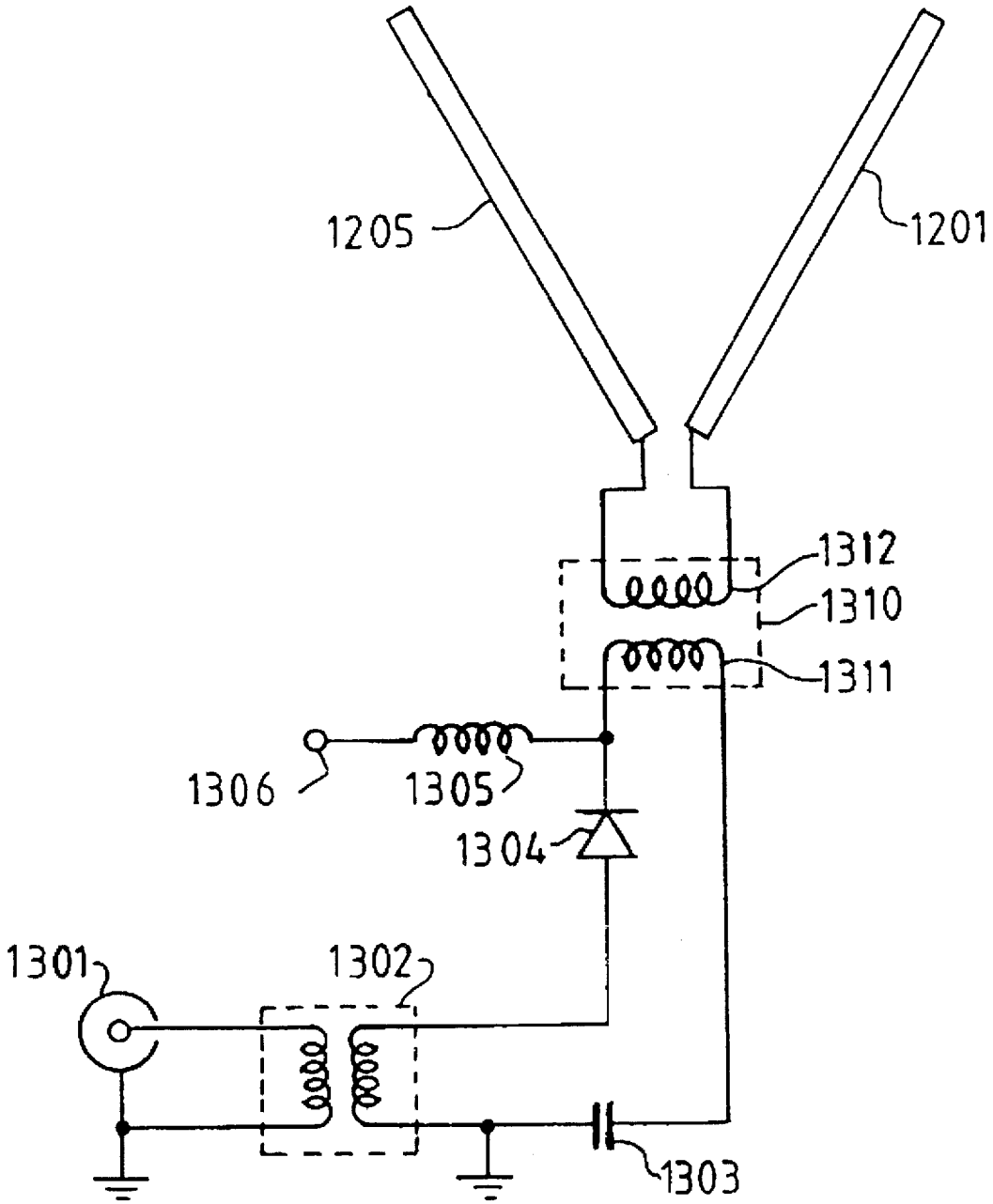
FIG. 13 is a schematic diagram showing the selection of individual coils used as an alternative to the commutator of FIG. 11 in the invention.

FIG. 13 shows such an arrangement using inductive coupling for the connection of rotor blades 1205 and 1201 when these rotor blades are connected to the apparatus for transmission and reception of radio waves. A connection 1301, preferably a coaxial connection, is made from the apparatus for transmitting and receiving radio waves to the apparatus shown in FIG. 13.

The following description will assume that a signal is to be transmitted by rotor blades 1205 and 1201. For a signal to be received the path would be reversed. The signal is inductively coupled through transformer 1302 for d.c. isolation. A signal is applied via connection 1306 in order to control the bias of diode 1304. This signal is pulse synchronized with the rotor shaft position and present when it is desired for the transmitted signal to be passed on to rotor blades 1205 and 1201. The signal is applied through an r.f. choke 1305 to prevent short circuiting of the transmitted signal through the bias supply. When the pulse is present the diode is forward biased and allows the transmitter signal to pass through to the inductive coupling mechanism 1310 to the rotor blades 1205 and 1201. Coil 1312 is on the rotor shaft and coil 1311 is mounted concentric with coil 1312, but is fixed to the fuselage 102. When the pulse is not present the diode is reverse biased and the transmitter signal cannot pass. The transmitted signal returns to the isolating transformer through d.c. blocking capacitor 1303. The diodes must be capable of handling the radiated r.f. power and the blocking capacitor must be capable of conducting the r.f. current.

In a preferred embodiment with five such rotor blades (1201, 1202, 1203, 1204, 1205), a single connection 1301, isolating transformer 1302 and d.c. blocking capacitor 1303 are used. For each blade there are separate diodes 1304 and inductive coupling mechanisms 1310. The series combinations of the diodes and inductive coupling mechanisms are connected in parallel between the isolating transformer and the d.c. blocking capacitor. The number of series combinations is the same as the number of blades, with the coils 1312 being connected between respective pairs of rotor blades.

The r.f. chokes 1305 connect from each diode to a respective source of timing pulses. The timing pulses are obtained from the rotor shaft by using a magnet fixed to the rotor shaft and a pickup coil for each pulse required. Alternatively, an arrangement of photo-optical coupling may be used. The pulses are shaped and the amplitude processed as required. They are then passed through a delay means, the amount of the delay being capable of being controlled external to the delay means. The control of the delay may be used to effect control of the angular position of the radiating lobe with respect to a fixed geographic position. All of the pulses are delayed by the same amount.

Alternatively the pulses could be generated by a pulse generator, synchronized by one shaft position pulse. Each control pulse is displaced from the preceding one by 72 degrees in the time domain in the case of a 5 bladed rotor assembly.

Phase Shift Configuration

In a second embodiment two adjacent rotor blades (1201, 1205) are fed in a 'V' configuration with the primary (that is, zero phase shift) radio frequency feed, which in itself results in a directional pattern in bipolar form (that is with a forward lobe and a backwards lobe). However there is still significant radiation directed in a direction opposite to the desired direction. To reduce this rotor blades (1202, 1204) are driven with a phase shifted (that is, displaced from zero degrees) signal to reinforce the forward lobe and provide for some cancellation effect for the back lobe. The amount of phase shift required may be established by mathematical modelling, as is known to those skilled in the art of antenna theory. Rotor blade 1203 can also be utilized in the same fashion (that is, fed with an out of phase signal or grounded to act as a reflector).

As the blades rotate approximately 72 degrees counterclockwise, the commutator wipers fed from the apparatus for receiving and transmitting radio waves disengage rotor blades 1205 and 1201 and instead engage blades 1201 and 1202 as the primary radiators. Blades 1201 and 1202 are similarly disengaged and blades 1202 and 1203 now engage the wipers with the phase controlled feed to provide reinforcement of the main lobe and a cancellation effect on the back lobe. The rotation of the commutator causes the connection of the blades, both primary feed and phase controlled feed, to change every 72 degrees of rotation.

In order to provide optimal communication between the directional antenna and another antenna, the directional antenna needs to be oriented so that a direction of increased gain is oriented toward the desired receiving antenna.

This can be achieved by rotating the commutator shell 1111 that connects to the transmitting and receiving apparatus so that the electrical conductors connect to the apparatus over a different portion of the arc swept by the conductors. The rotation of the commutator can be achieved by the use of a stepper motor 1152.

All modern aircraft equipment communicates with other equipment on the aircraft via a digital data bus. This data bus carries instructions from a central computer to the avionic equipment. The stepper motor 1152 is controlled via a suitable interface from such a data bus. The construction of such an interface is well known to those skilled in the art of design of avionic equipment. A flight computer is given the bearing of the receiver or transmitter with which it is desired to communicate. It also has access to the present course of the aircraft. From these it is able to determine the required position of the commutator and control the stepper motor 1152 and therefore the directionality of the antenna. As the aircraft changes course, the antenna remains oriented in the appropriate direction.

In all of the variations of the invention described above, as well as in prior art antennas it is necessary to include in the system an antenna tuning unit to allow the impedance of the antenna to be matched to the impedance of the transmitter and receiver over a wide range of frequencies. The design and construction of antenna tuning units is well known to those skilled in the art and will not be discussed further.

We claim:

1. An antenna system for high frequency communication in a rotary winged aircraft having a fuselage body provided with a plurality of electrically non-conductive rotor blades that are formed from a composite of non-metallic materials, said antenna system comprising:

conductive antenna means which extend longitudinally along a length of each of said plurality of rotor blades;

connection means for electrically connecting said antenna means to an apparatus for transmission and reception of a plurality of high frequency radio waves having wavelengths in a range from 10 meters to 150 meters, said connection means including a first means rotating with said plurality of rotor blades and electrically connected to said antenna means and a second means electrically coupled to said first means and fixed to said fuselage body and electrically connected to said apparatus for transmission and reception of said high frequency radio waves;

said antenna means including a plurality of electrical conductors each of which is affixed to a surface of a corresponding separate one of said plurality of electrically non-conductive rotor blades with each of said plurality of electrical conductors extending in parallel to a longitudinal axis of said separate one of said plurality of non-conductive rotor blades over substantially the full length of said corresponding separate rotor blade and constituting a radiating element of the antenna system.

2. The antenna system as claimed in claim 1 wherein each of said plurality of electrical conductors is positioned along a leading edge surface of said separate one of said plurality of non-conductive rotor blades and serves simultaneously as an erosion shield to protect said plurality of non-conductive rotor blades from damage.

3. The antenna system as claimed in claim 1 wherein each of said plurality of electrical conductors is positioned along a leading edge surface of said separate one of said plurality of non-conductive rotor blades and is simultaneously used as an electrical heater filament.

4. The antenna system as claimed in any one of claims 1, 2 or 3 wherein each of the plurality of electrical conductors is a conductive coating applied to the surface of each of said plurality of non-conductive rotor blades.

5. The antenna system as claimed in claims 1, 2 or 3 wherein the connection means comprises a first surface and a second surface, the first surface rotating with the plurality of rotor blades, the second surface being fixed to the fuselage body, the first and second surfaces being connected capacitively.

6. The antenna system as claimed in claims 1, 2 or 3 wherein the connection means comprises a first transformer winding and a second transformer winding, the first winding rotating with the plurality of rotor blades, the second winding being fixed to the fuselage body, the first and second windings being connected inductively.

7. The antenna system as claimed in claims 1, 2 or 3 wherein the connection means comprises slip rings and contact bushes.

8. A communication system in a rotary winged aircraft for transmission and reception of information in the form of a plurality of high frequency radio waves with wavelengths in a range from 10 meters to 150 meters, said rotary winged aircraft having a fuselage body provided with a plurality of electrically non-conductive rotor blades that are formed from a composite of non-metallic materials, the communication system comprising:

means for transmission and reception of said plurality of high frequency radio waves;

antenna means including a plurality of electrical conductors each of which is affixed to the surface of a corresponding separate one of said plurality of electrically non-conductive rotor blades with each of said plurality of electrical conductors extending in parallel to a longitudinal axis of one of said plurality of non-conductive rotor blades over substantially the full length of said corresponding separate rotor blade and constituting a radiating element of the communication system; and connection means comprising a first means rotating with said plurality of non-conductive rotor blades and electrically connected to said plurality of electrical conductors simultaneously and a second means fixed to said body and electrically connected to said means for transmission and reception of radio waves, said first means and said second means being coupled together electrically.

9. A directional antenna for use with an apparatus for transmission and reception of a plurality of high frequency radio waves in a rotary winged aircraft having a fuselage body provided with three or more electrically non-conductive rotor blades that are formed from a composite of non-metallic materials and are capable of being rotated with respect to said fuselage body of said rotary winged aircraft around an axis perpendicular to said rotor blades, the antenna comprising:

a plurality of electrical conductors rotatable with said rotor blades wherein each of said plurality of electrical conductors is affixed to a surface of a corresponding separate one of said rotor blades such that said each electrical conductor is positioned parallel to a longitudinal axis of said corresponding separate rotor blade over substantially the full length of said corresponding separate rotor blade, said plurality of electrical conductors constituting radiating elements for said high frequency radio waves which have wavelengths in a range from 10 meters to 150 meters;

means for dynamically selecting two of said plurality of electrical conductors as first electrical conductors and each of the other electrical conductors as second electrical conductors, said second electrical conductors not being electrically connected to said first electrical conductors, wherein said two electrical conductors selected as first electrical conductors are the closest in an angular position of said plurality of electrical conductors to a predetermined first angular position between said fuselage body and a remote apparatus for transmission and reception of high frequency radio waves, as said plurality of electrical conductors rotates with said rotor blades; and means for providing an electrical connection from the first electrical conductors to an apparatus for transmission and reception of high frequency radio waves.

10. The directional antenna as claimed in claim 9 wherein one or more of said second electrical conductors are provided with a signal that is out of phase with a signal provided to said first electrical conductors.

11. The directional antenna as claimed in claim 10 wherein the connection means comprises slip rings and contact brushes.

12. The directional antenna as claimed in claim 10 wherein the means for dynamically selecting each of said plurality of electrical conductors as first conductors or as second conductors comprises slip rings and contact brushes.

13. The directional antenna as claimed in claim 10 wherein the means for dynamically selecting each of said plurality of conductors as first conductors or as second conductors comprises electrical diodes and means for controlling the direct current biasing of the electrical diodes.

14. The directional antenna as claimed in claim 10 further comprising a control means for maintaining said first predetermined angular position with respect to a known geographic point.

15. The directional antenna as claimed in claim 14 wherein said control means comprises a stepping motor.

16. The directional antenna as claimed in 10 further comprising means for maintaining said first predetermined angular position constant with respect to a remote apparatus for transmitting or receiving radio waves.

17. A communications system for transmission and reception of a plurality of high frequency radio waves in a rotary winged aircraft having a fuselage body provided with three or more electrically non-conductive rotor blades that are formed from a composite of non-metallic materials and are capable of being rotated with respect to said fuselage body of said rotary winged aircraft around an axis perpendicular to said rotor blades, the communications system comprising:

means for transmission and reception of said plurality of high frequency radio waves;

a plurality of electrical conductors rotatable with said rotor blades wherein each of said plurality of electrical conductors is affixed to a surface of a corresponding separate one of said rotor blades such that said each electrical conductor is positioned parallel to a longitudinal axis of said corresponding separate rotor blade over substantially the full length of said corresponding separate rotor blade, said plurality of electrical conductors constituting radiating elements for said high frequency radio waves which have wavelengths in a range from 10 meters to 150 meters;

means for dynamically selecting two of said plurality of electrical conductors as first electrical conductors and each of the other electrical conductors as second electrical conductors, said second electrical conductors not being electrically connected to said first electrical conductors, wherein said two electrical conductors selected as first electrical conductors are the closest in an angular position of said plurality of electrical conductors to a predetermined first angular position between said fuselage body and a remote apparatus for transmission and reception of high frequency radio waves, as said plurality of electrical conductors rotates with said rotor blades; and means for providing an electrical connection from the first electrical conductors to the means for transmission and reception of high frequency radio waves.

* * * * *